United States Patent [19]

Kalinnikov et al.

[11] Patent Number: 4,737,704

[45] Date of Patent: Apr. 12, 1988

[54] TRANSFORMER FOR ARC AND PLASMA SETUPS HAVING BROAD CURRENT ADJUSTMENT RANGE

[76] Inventors: Semen A. Kalinnikov, Brest-Litovsky prospekt, 17, kv. 61; Vladimir A. Troitsky, ulitsa Sapernoe pole 26a, kv. 60; Arkady A. Dondysh, ulitsa Vasilkovskaya, 40, kv. 36; Frants F. Ditler, ulitsa Fedoseevskaya, 3, kv. 19; Viktor Y. Sazonov, ulitsa Dobrokhotova, 11, kv. 120; Gennady N. Shvets, prospekt Pobedy, 20, kv. 329; Vasily N. Olenich, prospekt Voroshilova, 17a, kv. 81, all of Kiev, U.S.S.R.

[21] Appl. No.: 927,562

[22] Filed: Nov. 6, 1986

[51] Int. Cl.[4] ..... G05F 3/04

[52] U.S. Cl. ..... 323/328; 219/116; 323/331; 323/335; 323/339; 336/165

[58] Field of Search ..... 323/250, 254, 258, 331, 323/334, 335, 338, 339, 343, 251, 253, 328; 219/114, 116, 121 EA, 137 PS; 336/165, 177

[56] References Cited

U.S. PATENT DOCUMENTS

| | | | |
|---|---|---|---|
| 1,609,141 | 11/1926 | Thompson | 336/165 |
| 3,147,455 | 9/1964 | Owen | 336/165 |
| 3,278,833 | 10/1966 | Owen | 219/116 |
| 3,938,030 | 2/1976 | Cornwell | 323/253 |
| 4,032,840 | 6/1977 | Lebedev et al. | 323/250 |
| 4,177,418 | 12/1979 | Brueckner et al. | 323/254 |

FOREIGN PATENT DOCUMENTS

| | | | |
|---|---|---|---|
| 395822 | 1/1974 | U.S.S.R. | 323/253 |

*Primary Examiner*—William H. Beha, Jr.

*Attorney, Agent, or Firm*—Fleit, Jacobson, Cohn & Price

[57] ABSTRACT

A variable-ratio transformer for arc and plasma setups, comprising a magnetic core made up of a main part composed of two yokes and legs in accordance with the number of phases and an additional part disposed on the side of the yoke of the main part of the magnetic core. The additional part of the magnetic core is made up of a yoke and legs whose number is equal to the number of the legs of the main part, at least one leg being placed with a gap in relation to the first yoke of the main part. The primary winding of each phase comprises two series-connected parts, the first part being located on the main part of the magnetic core, while the second part is located on the additional part thereof. A controlled electronic switch which regulates the load current flowing through the secondary winding of each phase, disposed on the main part of the magnetic core, is connected in parallel to one of the parts of the primary winding of each phase.

4 Claims, 3 Drawing Sheets

TRANSFORMER FOR ARC AND PLASMA SETUPS HAVING BROAD CURRENT ADJUSTMENT RANGE

FIELD OF APPLICATION

This invention relates to power supplies for arc and plasma setups and, in particular, to a variable-ratio transformer for arc and plasma applications, which is mostly used in engineering industry for welding, cutting, and hard-facing of metals.

BACKGROUND OF THE INVENTION

The basic requirements to variable-ratio transformers for arc and plasma setups consist in providing a wide range of load current adjustment, high efficiency, and uncomplicated construction, which are all interconnected. Designing a variable-ratio transformer satisfying all these requirements is a difficult technical task.

The existing variable transformers meet only some of these requirements.

Known in the art is a variable-ration transformer for arc and plasma setups, in which the magnetic core comprises two legs and three yokes - the upper middle, and lower ones. The primary winding and a part of the secondary winding are arranged in the window formed by the legs, the middle and lower yokes, while in the window formed by the legs, the middle and upper yokes, the second part of the secondary winding is located. The transformer also comprises a load current regulating means which is composed of bias windings positioned on the middle and upper yokes. By adjusting the current in the bias windings, a respective yoke is saturated, and by this the second part of the secondary winding is either included in or excluded from the magnetic flux circuit.

This variable-ratio transformer is deficient in that the structure of the transformer is too complicated due to the two yokes and bias windings.

The specific consumption of materials of this transformer is too high since the second part of the secondary winding is placed too far away from the primary winding and the first part of the secondary winding. Moreover, this arrangement of the transformer components is one of the contributing factors affecting the current adjustment range which is far too narrow.

And, finally, introduction of the bias windings which consume a substantial portion of the input power results in lower efficiency of the transformer.

Also known in the art is a variable-ratio transformer for arc and plasma applications, comprising a magnetic core composed of a main part formed by two yokes and legs in accordance with the number of the transformer phases, and an additional part located on the side of one of the yokes of the main part of the magnetic core, primary and secondary windings positioned on the main and additional parts of the magnetic core, and a means for regulating the load current flowing through the secondary winding.

In this variable-ratio transformer, the primary winding and the first part of the secondary winding are located on the main part of the magnetic core, while the second part of the secondary winding is disposed on the additional part of the magnetic core. The additional part of the magnetic core is made as two L-shaped elements, one element being placed stationary in relation to the main part of the magnetic core, and the other element being composed of two sections, one stationary and the other movable in relation to the main part of the magnetic core, in order to provide an adjustable non-magnetic gap between the stationary L-shaped element and the movable section of the second L-shaped element. The second part of the secondary winding of the transformer envelops this non-magnetic gap.

The load current regulating means is a screw with a handle which can be turned to move the movable section of the second L-shaped element and thereby increase or shorten the non-magnetic gap. Correspondingly, the inductive impedance of the second part of the secondary winding can be either reduced or increased in order to regulate the load current of the transformer.

This transformer is deficient in that in order to widen the control range thereof, the number of turns in the second part of the second winding has to be increased, which is a serious limitation to the transformer effective range because of the specific material consumption and overall dimensions.

Moreover, since the second part of the secondary winding of the transformer envelops the non-magnetic gap, additional losses due to leakage fields are inevitable, and this seriously affects the efficiency of the transformer.

One more disadvantage consists in that the transformer contains two L-shaped elements, which makes its structure too complicated.

BRIEF DESCRIPTION OF THE INVENTION

It is an object of this invention to provide a variable-ratio transformer for arc and plasma setups designed so that the adjustable range of the load current is made broader, the efficiency of the transformer is higher, and the structure of the transformer is simpler.

This object is achieved due to the fact that in a variable-ratio transformer for arc and plasma setups, comprising a magnetic core composed of a main part formed by two yokes and legs in accordance with the number of phases of the transformer and an additional part disposed on the side of one of the yokes of the main part of the magnetic core, primary and secondary windings whose number is equal to that of the phases and which are disposed on the main and additional parts of the magnetic core, and a means for regulating the load current flowing through the secondary winding of each phase, according to the invention, the additional part of the magnetic core is composed of a yoke and legs whose number is equal to that of the legs of the main part of said magnetic core, at least one leg being placed with a gap in relation to a respective yoke of the main part of the magnetic core, the primary winding of each phase being made up of at least two series-connected parts, one such part being disposed on the main part of the core, while the other on the additional part of the core, the load current regulating means being a controlled electronic switch connected in parallel wtih one of the parts of the primary winding of each phase.

Advisably, when in a variable-ratio transformer the primary winding of each phase is made up of three series-connected parts, the magnetic core should comprise a second additional part disposed on the side of the other yoke of its main part and composed of a yoke and legs whose number is equal to the number of legs in the first additional part of the magnetic core, at least one leg being placed with a gap in relation to the other yoke of the main part of the magnetic core, the third part of the primary winding should be in this case disposed on the second additional part of the magnetic core.

Advantageously, the magnetic core of the variable-ratio transformer should be provided with a spacer or a group of spacers made of a non magnetic material, which are placed in the gap between the leg of the additional part of the magnetic core and respective yoke of the main part of the core or in the gaps between the legs of the first and second additional parts of the magnetic core and respective yokes of the main part of the magnetic core.

In the variable-ratio transformer, according to the invention, the part of the primary winding, which is disposed on the additional part of the magnetic core, does not envelop the gap between at least one of the legs thereof and the yoke of the main part of the magnetic core. In consequence, the losses in this part of the primary winding, which had been caused by the leakage fields due to the "bulging" magnetic field near the gap, are eliminated. This makes the efficiency of the transformer much higher. Since a part of the primary winding is disposed on the additional part of the magnetic core, the load current can be regulated within a wider range without increasing the weight and size of the transformer as a whole. Moreover, the transformer is rather simple in structure due to uncomplicated design of the additional part of the magnetic core. The load current regulating means made as a controlled electronic switch makes the response of the transformer much faster and, consequently. the load current can be rapidly changed.

BRIEF DESCRIPTION OF DRAWINGS

The invention will now be described in greater detail with reference to a specific embodiment thereof, in conjuntion with the accompanying drawings, wherein.

DETAILED DESCRIPTION OF THE INVENTION

Figure 1:
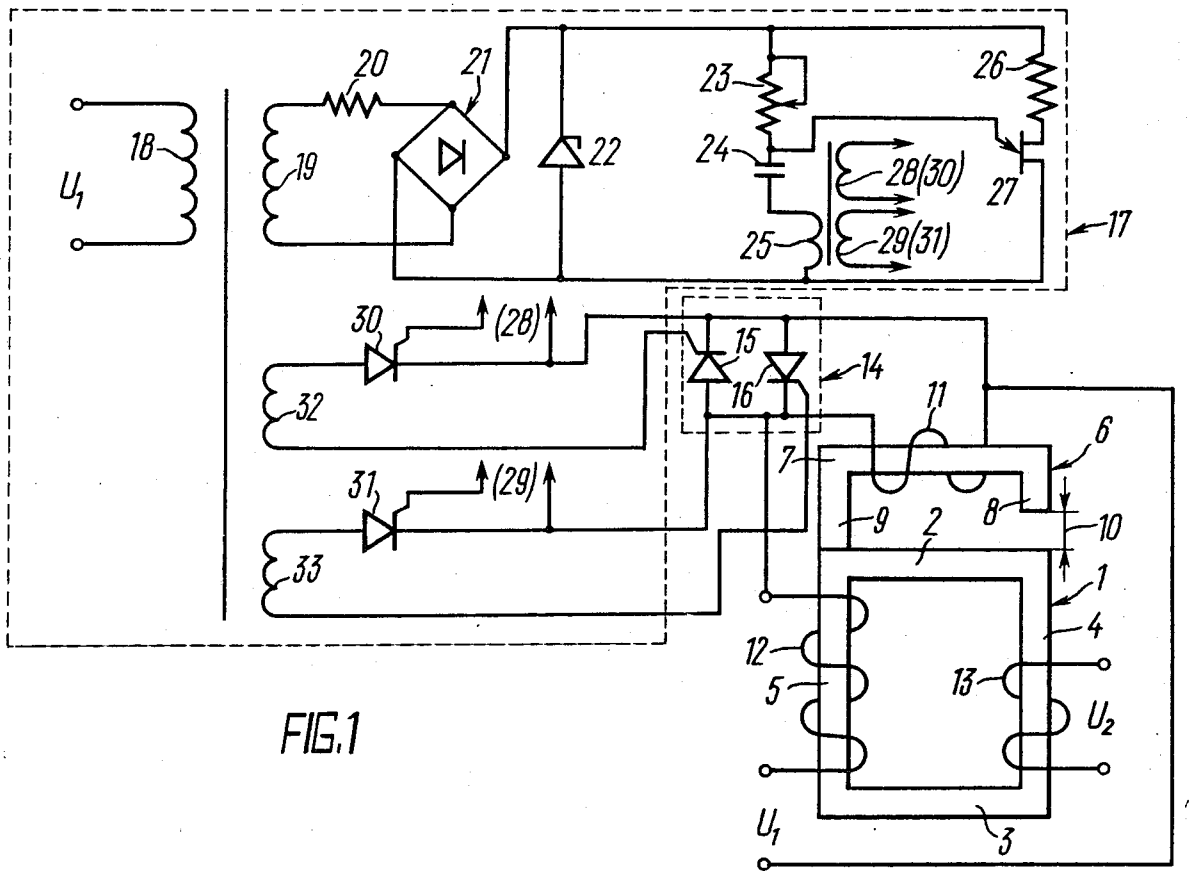
FIG. 1 shows a schematic diagram of a variable-ratio transformer for arc and plasma applications, according to the invenion.

A variable-ratio transformer fora rc and plasma setups, having one phase, comprises a magnetic core made up of a main part 1 (FIG. 1) composed of two yokes 2 and 3, and legs 4 and 5 in accordance with the number of phases of the transformer, and an additional part 6 composed of a yoke 7 and legs 8 and 9 whose number is equal to the number of legs 4 and 5 of the main part 1 of the magnetic core, said additional part 6 being disposed on the side of the yoke 2 of the main part 1 of the magnetic core. At least one of the legs of the additional part 6 of the magnetic core, which is in this embodiment the leg 8, is disposed with a gap 10 in relation to the yoke 2.

The variable-ratio transformer also comprises a primary winding made up of at least two series-connected parts, a part 11 disposed on the yoke 7 of the additional part 6 of the magnetic core and a part 12 disposed on the leg 5 of the main part 1 of the magnetic core. A secondary winding 13 is positioned on the leg 4. A means for regulating the load current flowing through the secondary winding 13 is connected parallel to the part 11 of the primary winding. This means is a controlled electronic switch 14. In this embodiment the controlled electronic switch 14 comprises two bipolar thyristors 15 and 16.

The design of the variable-ratio transformer, according to the invention, is essentially simple and ensures high efficiency.

The controlled electronic switch 14 is connected to a control circuit 17 comprising a transformer whose primary winding 18 is connected to a power source $V_1$ and whose secondary winding 19 is connected, via a resistor 20, to a rectifier bridge 21. The rectifier bridge 21 has its polar leads connected to a stabilizer diode 22, and, via a resistor 23, to a capacitor 24 and a primary winding 25 of the pulse transformer. A unijunction transistor 27 is connected, via a resistor 26, in parallel to the stabilizer diode 22.

Secondary windings 28 and 29 of the pulse transformer are connected to thyristors 30 and 31 which are, in turn, connected, via respective secondary windings 32 and 33 of the transformer, to the thyristors 15 and 16 of the controlled electronic switch 14.

The part 11 (FIG. 2) of the primary winding is structurally a coil installed on the yoke 7 of the additional part 6 of the magnetic core. But, in order to make the assembly of the variable-ratio transformer easier, the part 11 may be made of two coils installed on the legs 8 and 9 of the additional part 6. The part 12 of the primary winding and the secondary winding 13 are each made up of two coils installed coaxially on the legs 4 and 5 of the main part 1 of the magnetic core. The part 12 of the primary winding is placed inside the secondary winding 13.

Figure 3:
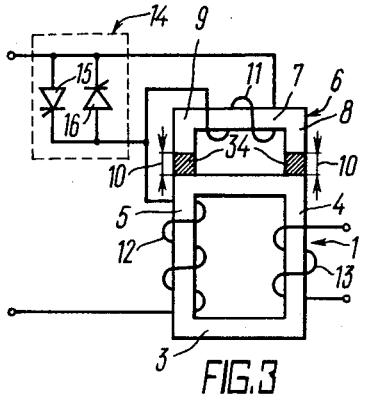
FIG. 3 the view of FIG. 1, illustrating the gaps between the legs of the additional part of the magnetic core and the yoke of the main part of the magnetic core, where spacers made of a non-magnetic material are placed, without the electronic switch control unit, according to the invention.

The variable-ratio transformer for arc and plasma applications, shown in FIG. 3, is basically similar to that of FIG. 1. But there is still differences. Both legs 8 (FIG. 3) and 9 of the additional part 6 of the magnetic core are placed with a gap in relation to the yoke 2 of the main part 1 of the magnetic core. Spacers 34 made of a non-magnetic material, e.g. fabric-based laminate, are placed in each gap 10. This also makes the assembly of the variable-ratio transformer more convenient.

In the variable-ratio transformer for arc and plasma applications, the magnetic core also comprises a second additional part 35 (FIG. 4) made up of a yoke 36 and legs 37 and 38 whose number is equal to the number of legs 8 and 9 of the main part 1 of the magnetic core. This second additional part 35 is disposed on the side of the yoke 3 of the main part 1 like the additional part 6.

Figure 2:
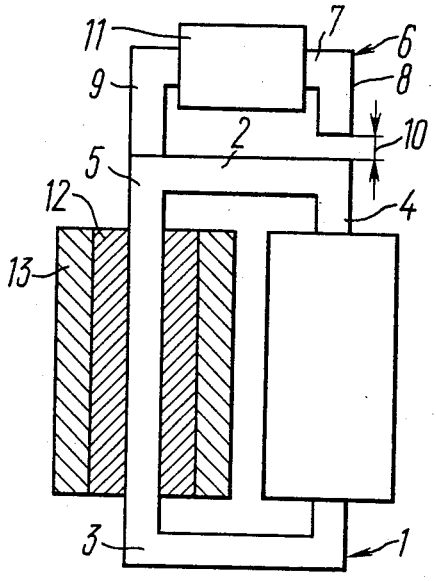
FIG. 2 shows a construction diagram of the transformer of FIG. 1, without the controlled electronic switch and its control unit, illustrating a longitudinal section view of one coil, according to the invention.

The primary winding of this embodiment of the variable-ratio transformer is composed of three parts. the first part 11 and the second part 12 are arranged as shown in FIG. 1, while a third part 39 is disposed on the yoke 36 of the second additional part 36 of the magnetic core. The arrangement of the part 12 of the primary winding and the secondary winding 13 is shown in FIG. 2.

Spacers 41 made of a non-magnetic material, similar to the material of the spacers 34, are placed in gaps 40 between the legs 37 and 38, and the yoke 3.

The three-phase embodiment of the variable-ratio transformer for arc and plasma applications is basically analogous to the single-phase embodiments described above. The difference consists in that the main part 1 (FIG. 5) and the additional part 35 of the magnetic core comprise each one more leg 42, 43, and 44, respectively. All legs 8, 9, 43, 37, 38, and 44 of the additional parts 6 and 35 are placed with gaps 10 and 40, in which spacers 34 and 41 are installed, in relation to respective yokes 2 and 3 of the main part 1 of the magnetic core. The parts 12, 45, and 46 of the primary windings and the secondary windings 13, 47, and 48 are coaxially arranged on the legs 5, 4, and 42 of the main part 1 of the magnetic core. The second parts 11, 49, and 50 of the primary windings are arranged on the legs 9, 8, and 43 of the additional part 6 of the magnetic core, respectively. The third parts 39, 51, and 52 of the primary windings are respectively disposed on the legs 38, 37, and 44 of the second additional part 35 of the magnetic core.

Figure 4:
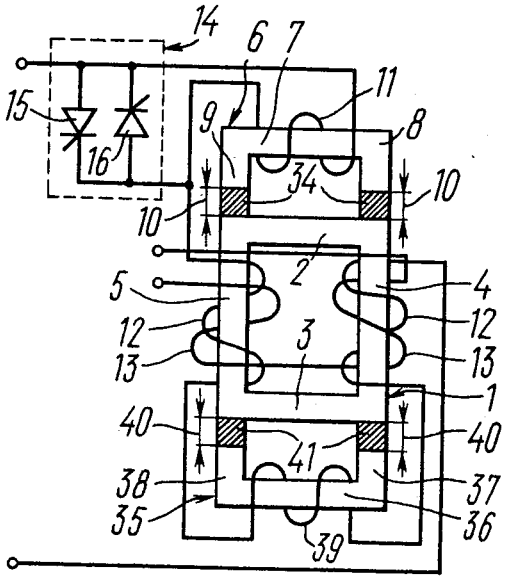
FIG. 4 shows the view of FIG. 3, illustrating a second additional part of the magnetic core, installed like the first additional part, but on the side of the other yoke of the main part of the magnetic core, according to the invention.
Figure 5:
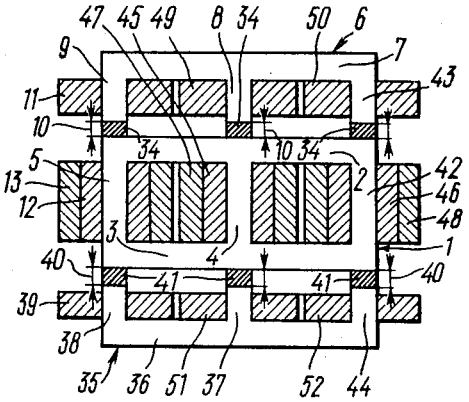
FIG. 5 shows a construction diagram of the transformer having three phases, illustrating a longitudinal section view, according to the invention.

In this embodiment of the variable-ratio transformer, the electronic switch 14 (FIGS. 1 and 4) is connected in parallel to each part 11, 49 (FIG. 5), and 50 of the primary windings (this connection is not shown in the construction diagram of FIG. 5).

Figure 6:
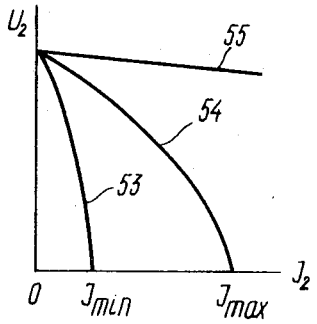
FIG. 6 shows plots of the load current and voltage across the secondary winding of the variable-ratio transformer versus the load impedance according to the invention.

For clarity and better understanding of the functioning of the variable-ratio transformer for arc and plasma applications, FIG. 6 supplies curves of the load current $I_2$ and voltage $V_2$ as functions of the load impedance, the load current $I_2$ being plotted on the X axis and the load voltage $V_2$ on the Y axis.

The variable-ratio transformer for arc and plasma applications operates as follows.

The load current is adjusted by changing the firing angle of the thyristors 15 (FIG. 1) and 16. The lower limit of the load current control range (curve 53 in FIG. 6) is reached when the thyristors 15 and 16 are turned off. In this case the short circuit impedance of the variable-ratio transformer is the sum of the impedances $Z_{1\beta}$and $Z_{1\alpha}$of the parts 11 and 12 of the primary winding and the secondary winding 13, which maintains the required minimal short circuit current $I_{min}$ (FIG. 6). When the variable-ratio transformer is running without load, the impedance of the part 11 of the primary winding is incompletely applied to the part 12 of the primary winding, while the voltage $V_1$ is almost completely aplied thereto due to the gap 10 (FIG. 1).

The secondary voltage $V_2$ of the variable-ratio transformer running under no-load conditions reaches, therefore its maximum and is given by $$V_2 = V_1(W_2/W_{1\alpha}),$$

where $W_2$ is the number of turns in the secondary winding 13, $W_{1\alpha}$is the number of turns of the part 12 of the primary winding The upper limit of the load current control range, indicated by the curve 54 in FIG. 6, is reached when the thyristors 15 and 16 are permanently turned on. In this case, the part 11 of the primary winding is short circuited, and the short circuit impedance of the variable-ratio transformer depends on the impedance $Z_{1\alpha}$of the part 12 of the primary winding and the second winding 13. It is, therefore, at its minimum.

When the part 12 (FIG. 2) of the primary winding and the secondary winding 13 are arranged coaxially, the slope of the curve 55 (FIG. 6) is insignificant, while on the other hand, when these windings are disposed on different legs, as in FIG. 1, the external characteristics is sharply curving downwards (curve 54, FIG. 6).

Using the control circuit 17 to gradually change the firing angle of the thyristors 15 (FIG. 1) and 16, a family of curves can be produced so that they are located within the area limited by the curves 53 and 54, or 53 and 55 (FIG. 6). The no-load voltage of the variable-ratio transformer in this case remains practically constant at its maximum. The load current control range is described by the following equation:

$$(Z_{1\beta}+Z_{1\alpha})/Z_{1\alpha}.$$

It is obvious that the primary current flowing through the part 11 of the primary winding is determined by the curve 53 of FIG. 6, while the primary current flowing through the part 12 of the primary winding is determined by the curve 54 or 55 of FIG. 6. The cross-section of the part 11 of the primary winding should, therefore, be less than the cross-section of the part 12 thereof by a factor by which $I_{min}$ is less than $I_{max}$. This means the part 11 of the primary winding may be small, and the wide control range is achieved without making the transformer substantially larger and increasing its specific material consumption.

The firing angle of thyristors 15 and 16 of the electronic switch 14 is generated in the control circuit 17 as follows. When the transformer winding 18 is connected to the power source $V_1$, the sinusoidal voltage is supplied, via the resistor 20, to the rectifier bridge 21. Since the stabilizer diode 22 is coupled in parallel to the rectifier bridge 21, the full-wave rectified voltage is supplied to the resistors 23 and 26 as a cut-off sinusoid. The capacitor 24 is charged through the circuit comprising the resistor 23, capacitor 24, primary winding 25 of the pulse transformer. The charging time is determined by the capacity of the capacitor 24, an insignificant resistance of the primary winding 25 and the resistor 23. When the voltage of the capacitor 24 reaches the turn on threshold of the transistor 27, the latter becomes conductive and the capacitor 24 discharges through the transistor 27 and the primary winding 25. Then, the capacitor 24 is charged again, and the process is repeated until the half-period of the supply voltage is over. In the next half-period the charging/discharging process in the capacitor 24 remains the same. The time required for the capacitor 24 to be charged to the turn-on threshold of the transistor 27 can be adjusted by changing the resistance of the resistor 23.

When the capacitor 24 is discharging, a current pulse flows in the primary winding 25 of the pulse transformer and induces voltage in the secondary windings 28 and 29, which is sufficient to make the thyristors 30 and 31 conductive. The thyristors 30 and 31 are alternately driven in conduction, and the voltage of the secondary windings 32 and 33 alternately opens thyristors 15 and 16. In this manner the firing angle of the thyristors 15 and 16 is changed by changing the resistance of the resistor 23.

The variable-ratio transformer featuring coaxially arranged part 12 (FIG. 2) of the primary winding and the secondary winding 13 can advisably be used in shot welding systems wherein thyristors 15 and 16 (FIG. 1) are turned on only for a part of the period of the sinusoidal supply voltage, and all curves between the curves 53 (FIG. 6) and 55 are artifically formed.

For conventional arc welding, the embodiment of the variable-ratio transformer of FIG. 1 is preferable. In this embodiment the part 12 of the primary winding and the secondary winding 13 are disposed on different legs 4 and 5 of the main part 1 of the magnetic core, and the magnetic leakage of the variable-ratio transformer is, therefore, increased. When the thyristors 15 (FIG. 1) and 16 are permanently turned on, the curve 54 (FIG. 6) has a slope required for nominal welding conditions. When the variable-ratio transformer is used for welding and its operational conditions are characterized by the curves 53 (FIG. 6) and 54, the load current curve distortions are substantially reduced, which improves the welding quality.

In the variable-ratio transformer of FIG. 4, the part 12 of the primary winding and the secondary winding 13 are made as shown in FIG. 2. This brings the magnetic dispersion to a minimum and adds to the efficiency of the transformer.

The variable-ratio transformer of FIG. 4 operates basically as described above. The difference consists in that the minimal current is achieved when the thyristors 15 and 16 are turned off. In this case the maximum inductive impedance of the variable-ratio transformer depends on all its windings: parts 11, 12, and 39 of the primary winding and the secondary winding 13, and the total size of the non-magnetic spacers 34 and 41. When the variable-ratio transformer is running idle, the inductive impedance of the parts 11 and 39 of the primary winding is very low, due to the spacers 34 and 41, in relation to the inductive impedance of the part 12. The secondary voltage is therefore at its maximum.

The maximum load current can be achieved when the thyristors 15 and 16 are completely turned off.

In this case, the part 11 of the primary winding is shunted by the thyristors 15 and 16, and the inductive impedance of the variable-ratio transformer is dictated by the impedance of the parts 12 and 39 of the primary winding, the secondary winding 13, and the width of the gaps 40 where spacers 41 are intalled. The inductive impedance of the variable-ratio transformer is, in this state, minimal, as shown in FIG. 6 by the curve 54.

The variable-ratio transformer of FIG. 5 operates in the same manner as the transformer of FIG. 4.

What is claimed is:

1. A variable-ratio transformer for arc and plasma setups, comprising:

a magnetic core made up of a main part and a first additional part;

said main part of said magnetic core, composed of a first yoke and a second yoke and a group of legs in accordance with the number of phases of said variable-ratio transformer;

said first additional part of said magnetic core, disposed on the side of said first yoke of said main part thereof and composed of a yoke and a group of legs whose number is equal to that of said legs of said main part and at least one of which is placed with a gap in respect of said first yoke;

a primary winding in accordance with the number of said phases made up of at least two series-connected parts, the first of said parts being disposed on said main part of said magnetic core and the second of said parts being disposed on said first additional part thereof;

a secondary winding in accordance with the number of said phases, disposed on said main part of said magnetic core;

a controlled electronic switch, which regulates the load current flowing through said secondary winding of each said phase, connected in parallel to one of said parts of said primary winding of each said phase.

2. A variable-ratio transformer as claimed in claim 1, comprising:

a second additional part of said magnetic core, disposed on the side of said second yoke of said main part thereof made as a yoke and a group of legs, whose number is equal to that of said legs of said first part and at least one of which is placed with a gap in respect of said second yoke;

said primary winding of each said phase, made of three series - connected parts, the third said part of said primary winding being disposed on said second additional part of said magnetic core.

3. A variable-ratio transformer as claimed in claim 1, comprising:

spacers made of a nonmagnetic material in accordance with the number of said gaps between said legs once with the number of said gaps between first additional part and said first yoke of said main part of said magnetic core, said spacers being disposed in said gaps.

4. A variable-ratio transformer as claimed in claim 2, comprising:

a group of spacers made of a nonmagnetic material in accordance with the gaps between said legs of said first and second additional parts and said first and second yokes of said main part of said magnetic core, said spacers being disposed in said gaps.

* * * * *